United States Patent [19]

White

[11] 3,945,681

[45] Mar. 23, 1976

[54] CUTTER ASSEMBLY

[75] Inventor: Kenneth M. White, Calgary, Canada

[73] Assignee: Western Rock Bit Company Limited, Calgary, Canada

[22] Filed: Oct. 29, 1974

[21] Appl. No.: 519,014

[30] Foreign Application Priority Data

Dec. 7, 1973 Canada ..... 187662

[52] U.S. Cl. ..... 299/86; 299/91

[51] Int. Cl.[2] ..... E21C 13/00

[58] Field of Search ..... 299/86, 85, 92, 94, 91, 299/95; 175/319, 383, 379, 322, 298

[56] References Cited

UNITED STATES PATENTS

| | | | |
|---|---|---|---|
| 2,728,556 | 12/1955 | House | 175/322 |
| 2,754,086 | 7/1956 | Summers | 175/322 |
| 3,399,928 | 9/1968 | Robbins | 299/94 X |
| 3,652,130 | 3/1972 | Elders | 299/86 |
| 3,697,137 | 10/1972 | Krekler | 299/86 |
| 3,833,264 | 9/1974 | Elders | 299/92 X |

*Primary Examiner*—John E. Murtagh
*Assistant Examiner*—Richard E. Favreau

[57] ABSTRACT

In known cutter assemblies, a cutter bit is dragged through a formation, thereby producing an unbalanced moment on the cutter bit which causes it to rotate. However, cuttings can lodge between the cutter bit and the holder, resulting in a frictional force greater than the unbalanced moment tending to rotate the cutter bit. The dragging of the cutter bit through a formation without its rotating causes the cutter bit to wear rapidly, necessitating its frequent replacement. The subject invention proposes to overcome the frictional force and to thereby increase the wear life of the cutter bit, by providing means whereby rotation is imparted to the cutter bit upon its initial contact with a formation. Thus, the inventive cutter assembly has a longitudinally and angularly extending groove situated on one of the cutter bit and the holder and a follower located on the other of the holder and the cutter bit. The follower engages the groove and moves therealong as the cutter bit moves longitudinally relative to the holder, thereby causing rotation of the cutter bit about its longitudinal axis relative to the holder.

11 Claims, 23 Drawing Figures

CUTTER ASSEMBLY

BACKGROUND OF THE INVENTION

This invention relates to a cutter assembly consisting of a cutter bit and a holder in which the cutter bit is rotatably mounted.

Cutter assemblies of this type are extensively utilized on continuous mining machines and to a lesser extent on rotary auger drills, ditching machines and land-breakers.

Rotation of the cutter bits in all assemblies presently available on the market is accomplished by combining a skew angle with the angle of attack such that the cutter bit drags through a formation. The movement of the cutter bit through the formation causes an unbalanced moment on the cutter bit about its longitudinal axis, resulting in rotation of the cutter bit. In comparatively dry, clean areas, this unbalanced moment is sufficient to cause rotation of the cutter bit. However, in many cases, cuttings lodge between the bearing surfaces of the cutter and the holder, creating a frictional force which exceeds the unbalanced moment on the cutter bit tending to cause rotation. In such cases the cutter bit drags over the formation without rotating and the cutter bit body wears rapidly until the hard-metal insert of the cutter bit falls out and the bit must be replaced.

BRIEF SUMMARY OF THE INVENTION

The subject invention proposes the provision of a positive initial rotation of the cutter bit whereby the static frictional force between the cutter bit and holder is overcome upon initial contact of the bit with the formation. Further means are disclosed for providing incremental rotation of the cutter bit such that improved hard-metal tip profiles can be utilized and cutter bit drag minimized by eliminating the skew angle.

According to the subject invention, a cutter assembly comprises in combination a cutter bit rotatable mounted in a holder. Either the cutter bit or the holder includes means defining a longitudinally and angularly extending groove while the other of the holder and the cutter bit supports a follower means which engages the groove means. As the cutter bit moves longitudinally relative to the holder, the follower means moves relative to the groove means, thereby causing rotation of the cutter bit about its longitudinal axis relative to the holder.

BRIEF DESCRIPTION OF THE DRAWINGS

In the accompanying drawings which illustrate embodiments of the invention.

DETAILED DESCRIPTION OF PREFERRED EMBODIMENTS

Figure 1:
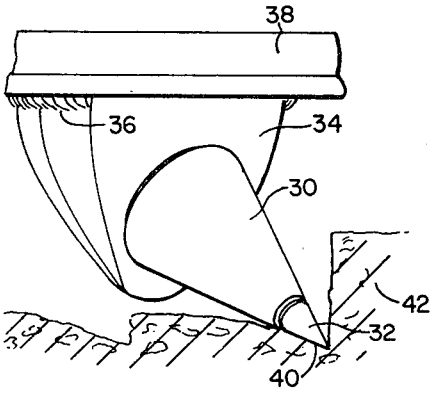
FIG. 1 is a frontal elevation of a cutter assembly in working position.

Referring to FIG. 1, cutter bit 30, having a hard-metal insert 32, is mounted in a holder 34, the holder 34 being attached by a weld 36 or other suitable means to the digging portion of an excavating assembly 38. During operation, a portion 40 of the cutter bit 30 rolls over the formation 42 being excavated. The length of the portion 40 is referred to as the rolling contact distance. This distance can be varied by changing the skew angle of the cutter bit assembly during initial welding of the cutter bit holder 34 to the digging machine. The hard-metal, tungsten carbide, insert 32 has a conical point to facilitate rolling along the formation.

Figure 2:
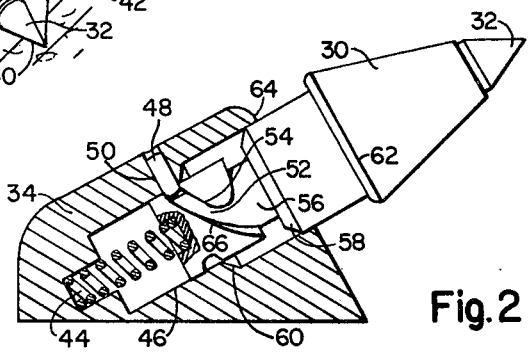
FIG. 2 is a side elevation of a cutter assembly, with the cutter bit holder partially broken away, as viewed with no load on cutter bit.

As shown in FIG. 2, a resilient means 44, such as a compression spring or the like, is situated between the end of the shank portion of the cutter bit 30 and the base of the opening 46 in the cutter bit holder 34 in which the cutter bit 30 is rotatably mounted. The resilient means 44 is axially aligned with the longitudinal axis of the cutter bit 30 and biases the cutter bit away from the base of the opening 46. A retainer pin 48 or the like is inserted through a passageway 50 in the cutter bit holder 34, the passageway 50 communicating with the opening 46. The follower means 48 engages a curved groove means 52 which is formed on the shank portion of the cutter bit 30 and extends longitudinally and angularly thereof.

Figure 3:
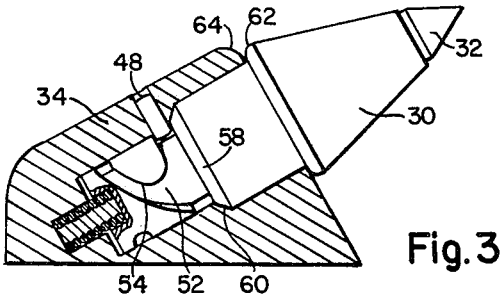
FIG. 3 is a side elevation of the cutter assembly of FIG. 2, as viewed with a load applied to the cutter bit.

Upon initial contact of the cutter bit insert 32 with the formation being excavated, a longitudinal force causes the cutter bit 30 to move into the holder 34 to the position shown in FIG. 3. As the cutter bit 30 moves into the holder 34, an end of follower means 48 contacts an inclined spiral surface 54 of the curved groove means 52, thereby causing the cutter bit to rotate. At the same time, the resilient means 44 is compressed and, as shown in FIG. 3, the relative position of the follower means 48 to the shank of the cutter bit 30 is such that the end of the follower means is free from the curved groove means 52 and is essentially centered in an annular groove 56 formed by the upper terminus of the curved groove means. In the position shown in FIG. 3, stop and thrust load surfaces 58 and 60, on the cutter bit 30 and cutter bit holder 34 respectively, come into contact and together with the surface of the shank portion of the cutter 30, function as bearing surfaces on which the bit 30 rotates. Secondary bearing surfaces 62 and 64 are provided on the cutter bit 30 and cutter bit holder 34 respectively, and come into contact should bearing surfaces 58 and 60 become worn. Utilizing a raised shoulder type of bearing surface 64 affords wear protection for the front edge of the cutter bit holder 34 and thereby increases its wear life.

When the longitudinal force due to excavating is removed from the cutter bit, resilient means 44 tends to force the cutter bit and holder, apart, thereby separating the stop and thrust load surfaces 58 and 60. As the resilient means expands, the end of follower means 48 comes into contact with inclined surface 66 of the curved groove means 52, thereby rotating the cutter bit 30 into a position ready for the next excavating cycle.

Figure 5:
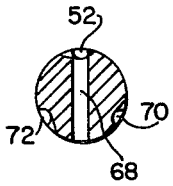
FIG. 5 is a cross-section of the cutter bit of FIG. 4 taken along the line V—V.
Figure 4:
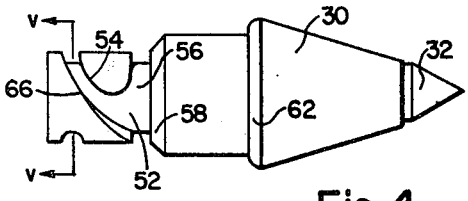
FIG. 4 is a side view of a cutter bit according to the invention.

In the embodiment of the cutter bit 30 shown in FIG. 4, the curved groove means 52 comprises three inclined spiral grooves for rotating the cutter bit. Provision is made for removal of follower means 48 when the cutter bit 30 is in the position shown in FIG. 2 and hole 68, according to FIG. 5, is in alignment with follower means 48. To permit removal of follower means 48, its overall length is less than the diameter of the shank portion of the cutter bit 30. When utilizing this method of cutter bit retention, only one follower means 48 is required and an identification mark is made on the cutter bit body so that visual alignment can be made between the follower means 48 and hole 68. Once the follower means and hole are aligned, the follower means can be driven into the hole with a suitable tool and the cutter bit can be replaced.

The section of the cutter bit shank shown in FIG. 5 includes curved groove means comprising three inclined spiral grooves 52, 70 and 72. The number of spiral grooves utilized in a particular cutter bit is dependent upon the operating conditions. Right hand and left hand spiral grooves can be utilized for right and left skew angles.

Figure 7:
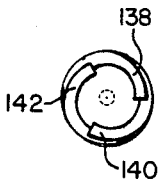
FIG. 7 is an end view of the rotating means illustrated in FIG. 6, looking in the direction of arrows VII—VII.
Figure 6:
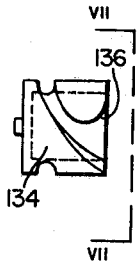
FIG. 6 is an exploded side view of a modified cutter bit and rotating means.
Figure 6:
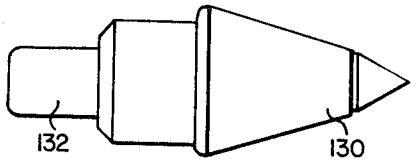

FIG. 6 shows a further embodiment of the invention in which the portion of the cutter bit assembly which includes the curved groove means is separate from the cutter bit body. Cutter bit 130 is provided with a cylindrical end 132 which can be inserted into a rotative means or sleeve 134. As shown in FIG. 7, the upper end 136 of the sleeve is sized to a diameter smaller than the diameter of the cylindrical end 132 by inwardly directed portions 138, 140 and 142 such that when the shank of the cutter bit 130 is inserted into the rotative means 134, accidental removal is effectively prevented.

When utilizing such a rotative means 134, one or more follower means can be utilized corresponding in number to the number of spiral grooves utilized on rotative means 134. Rotative sleeve 134 is suitably manufactured from spring steel and hardened to resist wear along the inclined spiral grooves.

Figure 8:
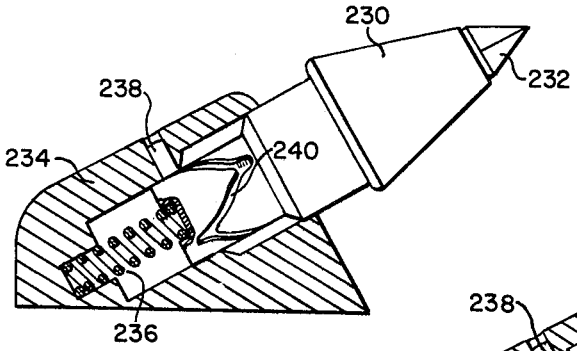
FIG. 8 is a side view of a cutter bit assembly, with the cutter bit holder partially broken away, in which provision is made for incremental indexing of the cutter bit.

In a further embodiment of the invention, the cutter bit assembly shown in FIG. 8 includes a cutter bit 230 having a special hard-metal insert 232 and mounted in holder 234. Resilient means 236 and follower means 238 are identical to those previously disclosed. In the unloaded position, as shown in FIG. 8, follower means 238 is at the rearmost position on the curved groove means 240 and resilient means 236 is extended. According to FIG. 9, cutter bit 230 is in the working position with the follower means 238 at the upper position on the curved groove means 240 and bearing against a surface 242 parallel to the longitudinal axis of cutter bit 230, as illustrated in FIG. 10. Since surface 242 is essentially parallel with the longitudinal axis of cutter bit 230, follower means 238 is maintained in a fixed position so long as a force is being applied to the cutter bit and thereby effectively prevents rotation of the cutter bit. When the cutting load is removed from the cutter bit, resilient means 236 causes the follower means 238 to come into contact with surface 244, thereby partially rotating the cutter bit 230 for the next working cycle.

Figure 9:
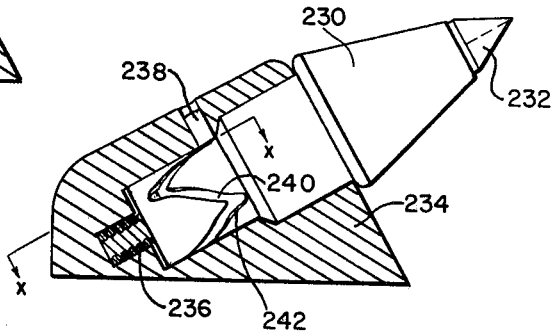
FIG. 9 is the cutter bit assembly illustrated in FIG. 8, with a load applied to the cutter bit.
Figure 10:
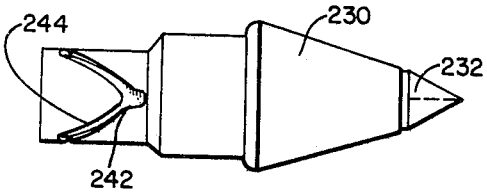
FIG. 10 is a side view of the cutter bit utilized in the cutter bit assembly illustrated in FIGS. 8 and 9, as viewed in the direction of the arrows X—X in FIG. 9.

When using the embodiment of the invention according to FIGS. 8 to 10, there is positive incremental rotation of the cutter bit on every working cycle. As a result, there is no need to have a skew angle on the cutter bit assembly to cause rotation of the cutter bit during excavation, and the power requirements of the excavating machine on which the assembly is mounted are reduced.

Figure 11:
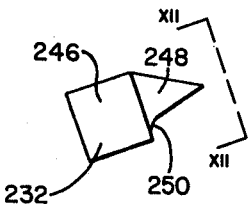
FIG. 11 is a side view of an improved hard-metal insert point profile.

The hard-metal insert 232 illustrated in FIG. 11 is of the type which would be utilized on the cutter bit according to FIG. 10. This insert consists of a substantially cylindrical mounting portion 246 and a pyramidal form of point 248 having a triangular base. A transition section 250 joins the triangular base with the cylindrical mounting portion such that stress concentrations are eliminated over this area. The insert shown in FIGS. 11 and 12 requires a 120 degree rotation per indexing increment so that there is a flat side on the pyramidal point essentially parallel to the surface of the material being excavated during the working cycle. The utilization of this point profile on the hard-metal insert generates a shearing and lifting action on the material being excavated, rather than a substantially compressive type of failure as in generated with a conically pointed insert. The number of sides forming the base of the pyramidal point profile is determined largely from the physical space limitations required for the spiral inclined grooves which result in the incremental rotation of the cutter bit. The hard-metal insert shown in FIG. 13 has a chisel-shaped point profile 252 requiring 180 degrees of rotation per indexing increment.

Figure 12:
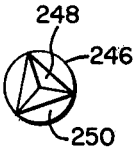
FIG. 12 is an end view of the insert shown in FIG. 11, looking in the direction of arrows XII—XII.
Figure 13:
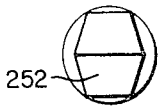
FIG. 13 is an end view of another form of point profile.
Figure 14:
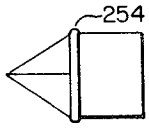
FIG. 14 is a side view of a hard-metal insert point profile having a flared wear protection feature.

The modified hard-metal insert in FIG. 14 is of the triangular based pyramidal form according to FIGS. 11 and 12, but includes a raised shoulder 254 for protection of the front of the cutter bit body. Provision of extra wear protection on the leading edge of the cutter bit body is important in that the carbide inserts are generally silver soldered or brazed into their mounting socket and the carburized and hardened cutter bit body is annealed in the area of maximum abrasive wear due to the carbide bonding operation.

Figure 16:
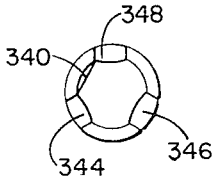
FIG. 16 is an end view of the incremental indexing mechanism shown in FIG. 15, viewed in the direction of the arrows XVI—XVI.
Figure 15:
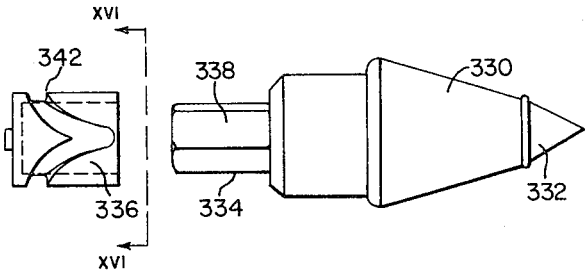
FIG. 15 is an exploded side view of a cutter bit and separate incremental indexing mechanism.

The embodiment of the invention according to FIGS. 15 and 16 is similar in principle to the embodiment illustrated in FIGS. 6 and 7 in that the rotative indexing means is separate from the cutter bit body. In FIG. 15, the cutter bit 330 includes a hard-metal insert 332, according to FIG. 14, and a shank portion 334 which releasably fits into the bore of the rotative indexing means 336. A flattened area 338 on the cutter bit shank 334 cooperates with a flattened area 340 in the interior of the rotative indexing means 336 such that the correct angular relationship between the rotative indexing means 336 and the flattened faces on the hard-metal insert 332 can be maintained when the cutter bit 330 is changed for sharpening or replacement. Provision for retention of the cutter bit in the rotative indexing means is made by reducing the indexing mean bore diameter at 342 such that the spring force generated at 344, 346 and 348 is sufficient to prevent accidental removal of the cutter bit 330.

Figure 18:
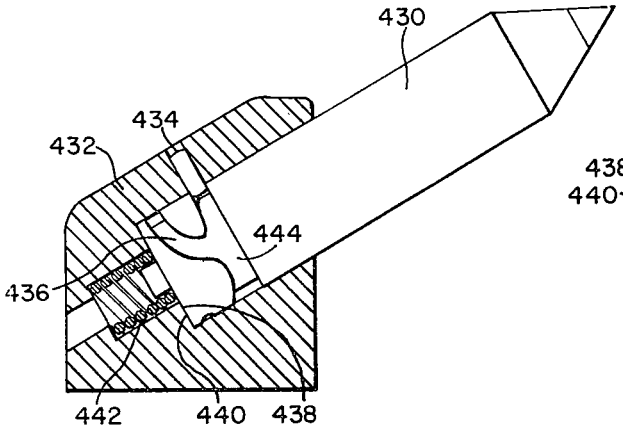
FIG. 18 is the cutter assembly according to FIG. 17 with a load applied to the cutter bit.
Figure 17:
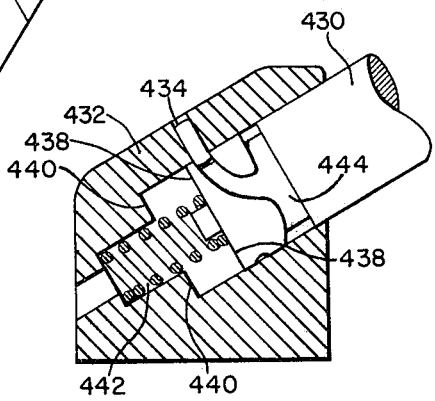
FIG. 17 is a partial view of a further embodiment of a cutter assembly according to the invention, with the holder broken away, in which the cutter bit has a substantially constant body diameter.

The embodiment of the invention shown in FIGS. 17 and 18 differs from the preceding embodiments in that the diameter of the cutter bit is constant over a majority of its length and the thrust loading due to digging is absorbed by a surface that is essentially perpendicular to the longitudinal axis of the cutter bit. Referring to FIG. 17, cutter bit 430 is mounted in cutter bit holder 432 and retained therein by follower means 434 such that during longitudinal movement of cutter bit 430 into holder 432 an end of the follower means 434 engages a curved groove means 436, resulting in rotation of the cutter bit 430 relative to holder 432. As a result, perpendicular axial thrust surfaces 438 and 440 come into contact, as shown in FIG. 18, and resilient means 442 is fully compressed. Follower means 434 is essentially centered in annular groove 444, free of the curved groove means 436, such that free rotation of the cutter bit 430 can occur. It is to be understood that incremental indexing, as disclosed in connection with FIGS. 8 and 10, could be incorporated in this particular cutter bit body 430. The primary advantage of providing essentially perpendicular thrust faces 438 and 440 is the absence of any wedging action generated due to inclined faces as occurs in the previously disclosed cutter bits. Also, since the cutter bit body 430 is constant in diameter, there is a more even stress distribution due to the absence of abrupt changes in body diameter necessitated by provision for inclined thrust faces.

Figure 19:
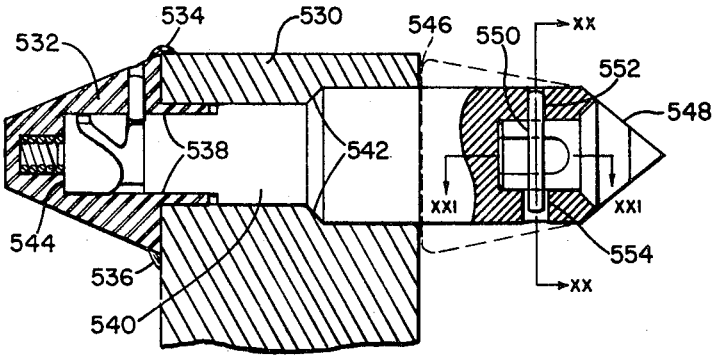
FIG. 19 is a vertical section of an adapter for converting a conventional cutter bit holder to the positive rotation method disclosed by the invention.

The embodiment of the cutter bit assembly shown in FIG. 19 has a cutter bit holder 530 as is in common usage, and a positive rotation adapter block 532 attached to the holder 530 by suitable means, such as by welds 534 and 536. The rotative features utilized may be the same as those shown in FIG. 2 or FIG. 8. Rotative adapter block 532 has a forwardly extending collar portion 538 of reduced diameter to provide a sliding fit into the bore of holder 530 such that alignment of the block and holder can be readily maintained during the welding operation. Cutter bit 540 has thrust faces 542, 544 and 546, the latter indicated by phantom lines, as integral features. By providing a positive rotative means as an adapter to an existing worn cutter bit holder, the axial thrust surface facing surface 542 will likely be worn and contact will not occur at this point. For this reason, perpendicular thrust faces 544 are provided, similar to surfaces 438 and 440 in FIGS. 17 and 18. It is further understood that in a conversion of a new cutter bit holder 530 all three surfaces 542, 544 and 546 could be in contact so that the peening action resulting from the absorption of the shock generated by the longitudinal movement of the positive rotative assembly 540 could be distributed to the three aformentioned surfaces and contact stresses minimized. A further provision in the embodiment of FIG. 19 is the method of retention of a hard metal insert holder 548. Retainer 550 is provided and is press fitted in hole 552 such that it is retained in the positive rotating assembly 540. A second hole 554 is oversized with respect to the retainer pin diameter and the pin 550 is free to bend about its press fit end.

Figure 20:
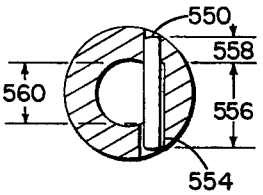
FIG. 20 is a section of the adapter illustrated in FIG. 19, taken along line XX—XX.

In FIG. 20, which is a section taken along line XX-XX of FIG. 19, retainer pin 550 is shown as a spiral spring pin or slotted pin and the depth of the oversized hole 554 is shown as the distance 556. The press fit depth of the hole 552 is shown as 558. Hard metal insert holder 548 contacts the retainer pin 550 at 560. The loading on the retainer pin 550 can be analyzed as for a circular cantilever beam having a uniformly distributed load over a distance 560, the portion of its length which engages the hard-metal insert. By varying the ratio between distances 556 and 558, various actual retaining forces can be achieved.

Figure 21:
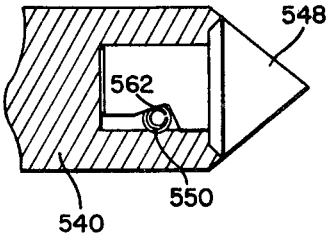
FIG. 21 is an enlarged section taken along line XXI—XXI, of the adapter illustrated in FIG. 19.

FIG. 21 shows an enlarged section taken along line XXI-XXI of FIG. 19, with slotted retainer pin 550 shown in cross-section. The contact point of pin 550 with hard-metal insert holder 548 occurs along an inclined face 562. In the embodiment according to FIG. 19, it is preferred that the hard-metal insert holder 548 not rotate relative to the positive rotative assembly 540; surface 562 therefore forms a flattened area such that pin 550 also prevents rotation. If rotation of holder 548 is desired, an annular groove can be provided such that the retainer pin 550 is free of the groove when holder 548 is fully seated and in working operation.

Figure 22:
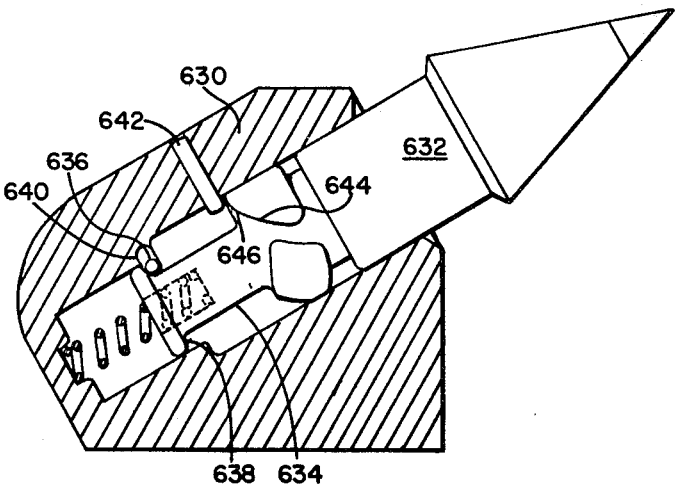
FIG. 22 is a further embodiment of the cutter assembly according to the invention, with no load applied to the cutter bit.

The embodiment of the invention shown in FIG. 22 consists of the cutter bit holder 630 and cutter bit 632 having an annular recess provided at 634 for retainer pin 636. In the extended position shown in FIG. 22, retainer pin 636 bears against stop surface 638 and prevents accidental removal of cutter bit 632 from the holder 630. An elongated slot 640 is provided in the holder 630 for retainer pin 636 to operate in the same manner as the embodiment of the invention described with respect to FIG. 20. The elongated slot 640 is provided in lieu of a larger diameter hole. A portion of the slot provided for the retainer pin is smaller in width than the diameter of the retainer pin so as to provide a press fit action for retention of the pin 636 in holder 630. The axial length of the annular recess at 634 corresponds to the longitudinal movement of the cutter bit 632 into and out of the holder 630. Follower means 642 engages curved groove means 644, thereby initiating rotative movement of the cutter bit 632 relative to the holder 630, as described previously. In this embodiment of the invention, follower means 642 comprising one or more pins may be utilized since the pins do not act to retain the cutter bit in the holder. The only requirement on the number of such pins is that if one pin is in angular alignment with an inclined groove of the curved means, all the other pins are also in alignment with corresponding inclined grooves.

Figure 23:
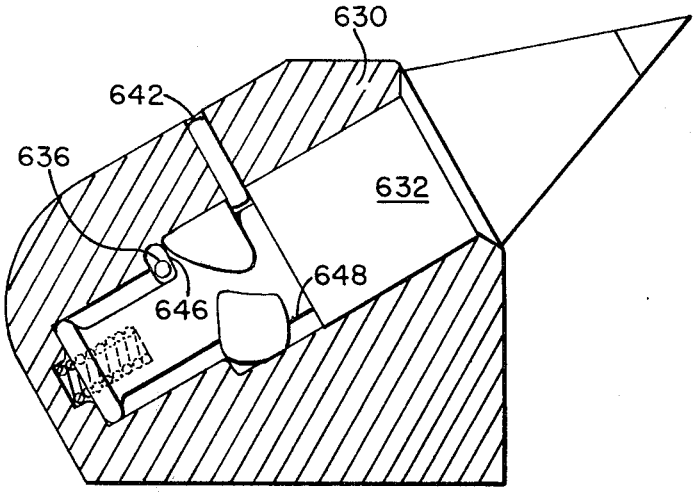
FIG. 23 is the embodiment shown in FIG. 22 in working position.

FIG. 23 shows the cutter bit 632 fully inserted into a holder 630 as would be found during working operation. It is noted that retainer pin 636 is in the forwardmost portion of the annular recess 634 but is not in contact with the cutter bit at position 646. Follower means 642 is essentially centered in the annular groove provided at 648, such that cutter bit 632 is free to rotate within holder 630. Incremental indexing as described in relation to the embodiments of FIGS. 8 and 15 can be incorporated in this embodiment by providing parallel stop surfaces for follower means 642 to bear against instead of an annular groove at 648.

What I claim my invention is:

1. A cutter assembly comprising a cutter bit rotatably mounted in a holder, longitudinally and angularly extending groove means fixed in position relative to one of the cutter bit and the holder, follower means positioned in the other of said holder and cutter bit, said follower means co-operating with said groove means to effect axial and rotative movement of said cutter bit relative to said holder when said cutter bit is axially moving from a fully extended to a fully depressed working position, said rotative movement of said cutter bit being less than one full revolution when said cutter bit moves axially from said fully extended to said fully depressed working position.

2. A cutter assembly according to claim 1, wherein said groove means communicates with an annular groove and said follower means is cooperable with said annular groove when said cutter bit has moved axially into said holder and said cutter bit is in a working position, whereby said cutter bit is rotatable about its longitudinal axis relative to said holder.

3. A cutter bit assembly according to claim 1, wherein said follower means is releasably secured to said holder and completely insertable into a cooperating opening in said cutter bit during disassembly, whereby said cutter bit can be removed from said holder.

4. A cutter assembly according to claim 1, wherein a retainer pin is releasably secured to said holder and engages an annular recess in said cutter bit, said recess having a length corresponding to a distance which the cutter bit moves longitudinally relative to said holder, said retainer pin preventing removal of said cutter bit when said pin is in engagement with said cutter bit.

5. A cutter assembly according to claim 1, wherein said groove means is substantially sinusoidal, to effect positive incremental rotation of the cutter bit.

6. The cutter assembly according to claim 1, wherein a resilient means mounted between said cutter bit and said holder biases said cutter bit in a direction longitudinally out of said holder, whereby said cutter bit is urged in a direction out of said holder when said cutter bit is in a non-working position.

7. A cutter assembly according to claim 6, said groove means including a portion parallel to a longitudinal axis of the cutter bit, said parallel portion restricting relative rotative movement of the follower means with respect to the groove means and rotation of said cutter bit relative to said holder when said cutter bit is in a working position, and said follower means becoming disengaged from said parallel portion as said cutter bit moves from said working position and said resilient means biases said cutter bit in a direction out of said holder.

8. A cutter assembly according to claim 1, wherein said groove means is located on a sleeve releasably secured to said cutter bit and said follower means is secured to said holder.

9. A cutter assembly according to claim 8, wherein said sleeve is releasably secured to said cutter bit in a fixed angular position relative to said cutter bit.

10. A cutter assembly according to claim 1, wherein said groove means comprises at least one curved inclined groove fixed in position relative to one of said cutter bit and said holder and said follower means comprises at least one pin secured to the other of the holder and the cutter bit.

11. A cutter assembly according to claim 10, there being a pin corresponding to each curved inclined groove.

* * * * *